US005878886A

United States Patent [19]

Marshall

[11] Patent Number: 5,878,886

[45] Date of Patent: Mar. 9, 1999

[54] DISPLAY PACKAGE FOR PULL CHAINS AND THE LIKE

[76] Inventor: John C. Marshall, 6249 Thibodeaux Rd., Greenwell Spring, La. 70739

[21] Appl. No.: 716,903

[22] Filed: Sep. 20, 1996

[51] Int. Cl.[6] ..... B65D 73/00

[52] U.S. Cl. ..... 206/470; 206/348; 206/471

[58] Field of Search ..... 206/736, 740–744, 206/461, 467, 470, 471, 348, 486

[56] References Cited

U.S. PATENT DOCUMENTS

| | | | |
|---|---|---|---|
| D. 195,737 | 7/1963 | Bassett . | |
| D. 281,580 | 12/1985 | Stevens . | |
| D. 346,114 | 4/1994 | Winston . | |
| D. 349,239 | 8/1994 | Steenland . | |
| 2,624,457 | 1/1953 | Jablon | 206/348 |
| 3,695,514 | 10/1972 | Mascetti, Jr. . | |
| 3,786,982 | 1/1974 | Rakes et al. . | |
| 4,020,694 | 5/1977 | Mayhew | 206/806 |
| 4,423,811 | 1/1984 | Knapp . | |
| 4,512,474 | 4/1985 | Harding . | |
| 4,669,610 | 6/1987 | Lindsey et al. | 206/461 |
| 4,739,883 | 4/1988 | Mohs et al. | 206/467 |
| 4,804,984 | 2/1989 | Heuer et al. | 206/461 |
| 4,997,153 | 3/1991 | Feibelman . | |
| 5,176,258 | 1/1993 | Antal . | |
| 5,593,036 | 1/1997 | Dyble et al. | 206/470 |

*Primary Examiner*—Paul T. Sewell
*Assistant Examiner*—Luan K. Bui
*Attorney, Agent, or Firm*—Joseph W. Berenato, III

[57] ABSTRACT

A package for displaying pull chains and the like includes a first transparent package component having a recess spanning substantially the entirety thereof. The recess has first and second sections and the second section is sized and configured for receipt of an article. A second package component has first and second spaced apart recess sections. The second component second recess section is aligned with the first component second recess section for therewith forming a chamber. An insert is positioned within the first component recess in overlying relation to the second component recess sections. The insert has a capture region for engaging an article having a portion thereof disposed within the chamber for display. The first and second components are secured together.

19 Claims, 2 Drawing Sheets

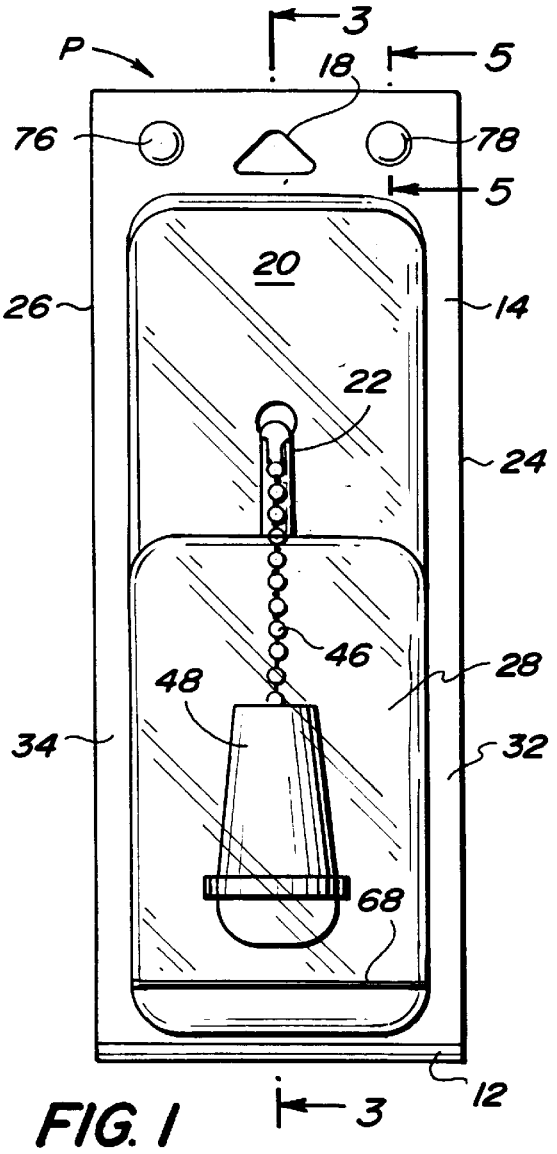
FIG. 1
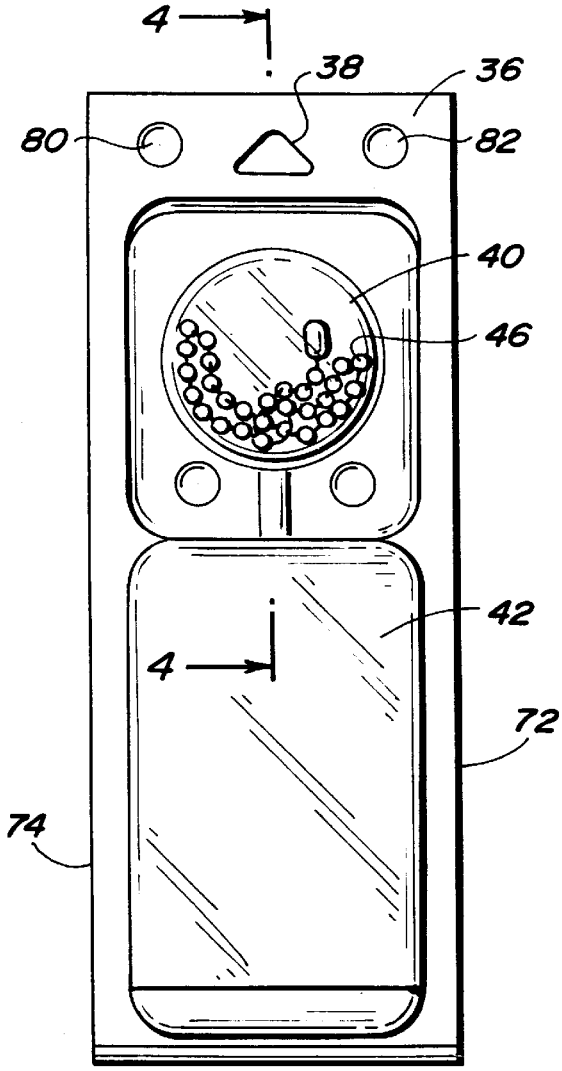
FIG. 2
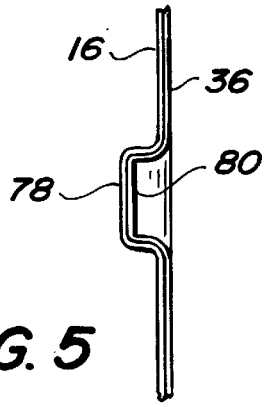
FIG. 5
FIG. 6
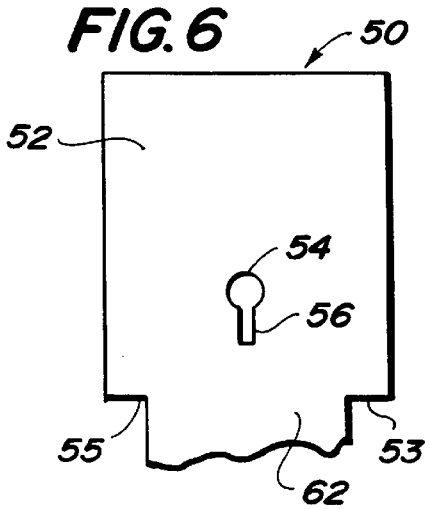

DISPLAY PACKAGE FOR PULL CHAINS AND THE LIKE

FIELD OF THE INVENTION

The disclosed invention is a display package for pull chains and similar articles sold to consumers by retailers and others. More particularly, the disclosed invention is a clam shell package in which an insert is positioned for holding the chain of a pull chain, so that the knob is suspended in a chamber to more realistically portray the appearance as same would occur when affixed to a ceiling fan.

BACKGROUND OF THE INVENTION

Retail establishments are under constraints to reduce costs while increasing sales. Suppliers to retail establishments are encountering similar constraints and demands, with retailers limiting display space to those products which achieve maximum sales potential. The manner in which a product is displayed, and thereby perceived by a consumer, frequently has a strong impact on sales of the packaged product. In addition, particularly with relatively small items, it is preferred that the package construction, size, or the like provide theft resistance.

A ceiling fan typically has a relatively short chain connected to a speed switch, with the switch being adjusted to set the speed of rotation of the fan blades to that which is desired. The short chain may not be reachable by the user, or same may be considered unattractive. Many consumers attach an extension chain to the short chain which comes with the fan, and the extension chain typically has a decorative knob or like ornament at its end. The knob and the chain may be colored or otherwise decorated in order to match the decor of the ceiling fan, the room in which the ceiling fan is positioned, or some other aesthetically pleasing attribute.

Ceiling fan extension pull chains have in the past been displayed to consumers on bubble cards. The typical bubble card has a cardboard base, to which a transparent bubble is secured. The extension chain and its knob are positioned within the bubble, and the card may be hung from a hook. In that configuration, however, the chain and knob are not presented to the consumer in an orientation corresponding to the orientation same would achieve when connected to the chain of the ceiling fan. The bubble package does not permit the consumer to easily recognize the coloring of the chain, or the ornamentation on the knob. The consumer must imagine how the chain and knob will appear with this sort of package, with the result that sales potential is potentially diminished.

Attempts have been made to increase consumer perception of the extension chain by display of the chain and its knob in a transparent carton having a cardboard insert. Those carton-type packages, however, do not display the extension chain and its knob in an orientation and configuration as would be achieved hanging from the ceiling fan. Additionally, portions of the chain remain loose in the package, and thus detract from an aesthetically pleasing appearance. Moreover, the carton-type package is relatively expensive to manufacture, and is relatively complicated to assemble.

Those skilled in the art will appreciate that there is a need for a relatively inexpensive, easy to manufacture, aesthetically pleasing, package suitable for display of ceiling fan extension pull chains, other sorts of pull chains, and similar types of products. The disclosed invention meets these needs and others in the art through provision of a transparent clam shell-type package, with an insert disposed in the package for securing the chain while allowing the knob to hang vertically within an open chamber, resulting in an appearance approximating the appearance of the pull chain and knob when hung from a ceiling fan.

SUMMARY OF THE INVENTION

A package for displaying pull chains and the like comprises a first transparent package component having a recess spanning substantially the entirety thereof The recess has first and second sections. The second section is sized and configured for receipt of a preselected article. A second package component is provided, with the second component having first and second spaced apart recess sections. The second component second recess section is aligned with the first component second recess section for therewith forming a chamber. An insert is positioned within the first component recess in overlying relation to the second component recess sections. The insert has a capture region for engaging an article, so that a portion of the article is disposed within the chamber for display. The first and second components are secured together.

A display package comprises a first transparent package component having a recess sized and configured for receipt of an article to be displayed. A second package component is secured to the first component. The second component has a first recess section and a second recess section. The second recess section is aligned with and cooperates with the recess for therewith forming a chamber. An insert has a first portion positioned within the recess, and a second portion disposed within the second component second recess section. The first portion of the insert includes a capture region. An article to be displayed has a portion immovably received within the capture region, and another portion extending therefrom and received within the chamber.

These and other objects and advantages of the invention will be readily apparent in view of the following description and drawings of the above-described invention.

DESCRIPTION OF THE DRAWINGS

The above and other advantages and novel features of the present invention will become apparent from the following detailed description of the preferred embodiment of the invention illustrated in the accompanying drawings, wherein:

FIG. 1 is a front elevational view of the package of the invention;

FIG. 2 is a rear elevational view thereof,

FIG. 5 is a fragmentary cross sectional view taken along the line 5—5 of FIG. 1 and viewed in the direction of the arrows; and FIG. 6 is a fragmentary plan view of the insert of the invention.

DETAILED DESCRIPTION OF THE INVENTION

Figure 3:
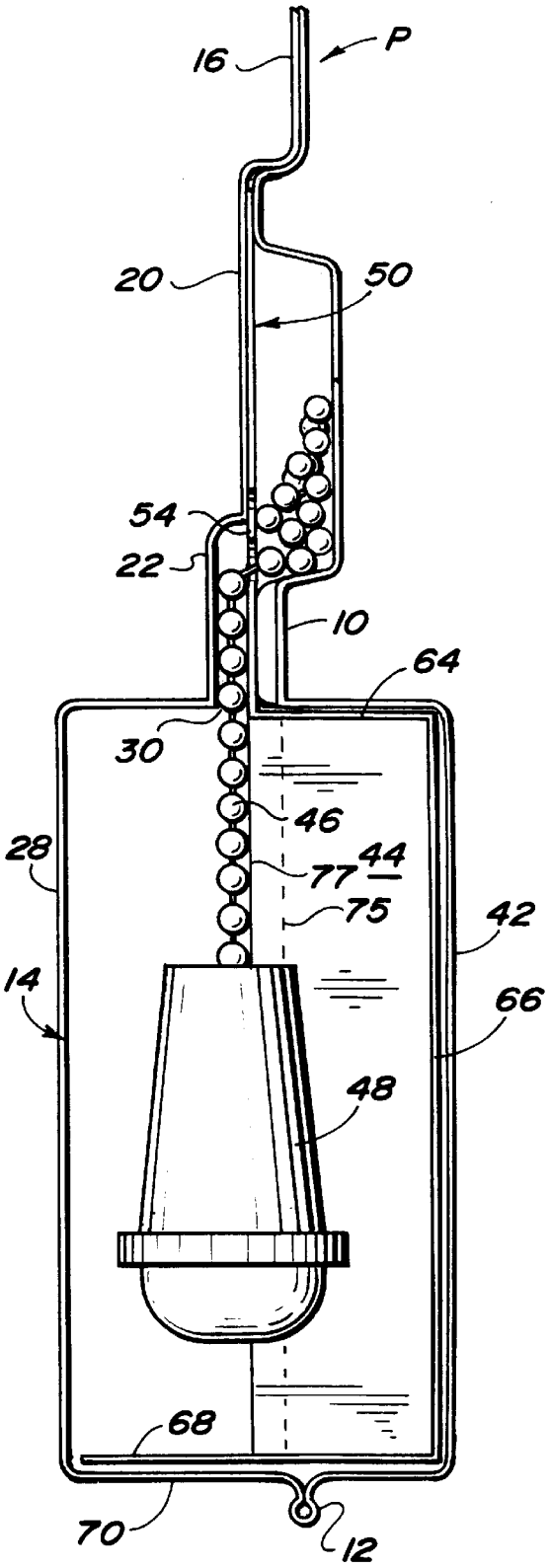
FIG. 3 is a cross sectional view taken along the line 3—3 of FIG. 1 and viewed in the direction of the arrows.

Package P, as best shown in FIGS. 1 and 3, is a clam shell-type package having a transparent package component 10 connected through hinge 12 to transparent package component 14. Components 10, 12 and 14 are integral, and are preferably made of a relatively thin transparent plastic of the sort suitable for vacuum molding. Because the plastic is transparent, then a consumer may easily view the contents of the package P.

Component 14 has an upper portion 16 in longitudinal alignment with hinge 12. A triangular opening 18 is formed therein for permitting the package P to be hung from a hook or other sort of fixture. Extending from first portion 16 is second portion 20, which is laterally offset from the plane of first portion 16. Finger portion 22 is formed in second portion 20, and creates a curved channel for reasons to be explained. As best shown in FIG. 1, finger portion 22 is centrally aligned relative to the oppositely disposed side edges 24 and 26, and preferably is in line with the longitudinal center line of the package P. Recess section 28 extends from second portion 20. Recess section 28 has an opening 30 communicating with finger portion 22. As best shown in FIG. 1, first portion 20 and recess section 28 combine to form a recess which spans substantially the entirety of second component 14. The recess formed by the portions 20 and 28 is disposed inwardly relative to peripheral rims 32 and 34 and downwardly from planar portion 16, and thereby provides strength and rigidity to the component 14.

Figure 4:
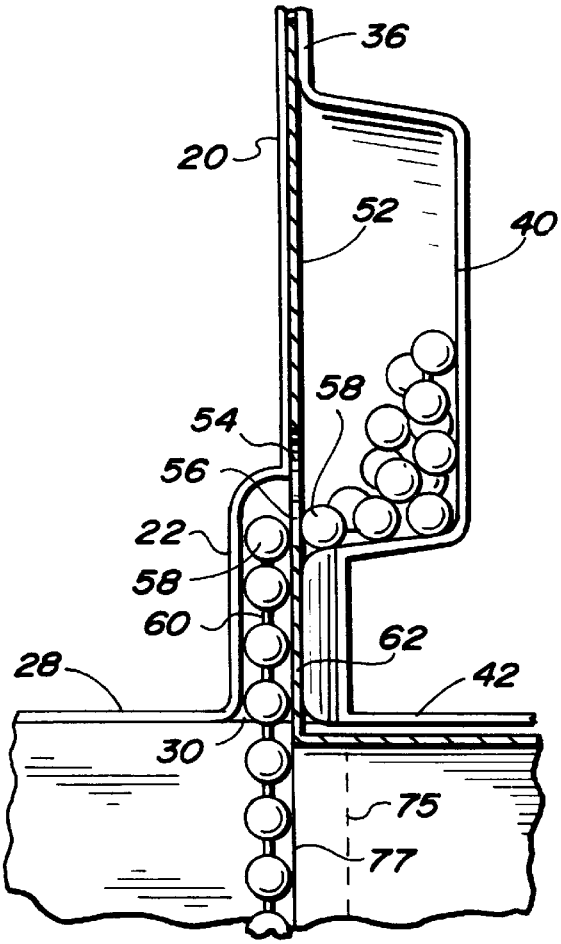
FIG. 4 is a fragmentary cross sectional view taken along the line 4—4 of FIG. 2 and viewed in the direction of the arrows.

Component 10 has an upper portion 36 having an opening 38 in alignment with the opening 18 of second component 14. Circular recess 40 is formed within component 10, as best shown in FIGS. 2–4. Spaced longitudinally downwardly from circular recess 40 is recess section 42, which is aligned with recess section 28 of component 14. The recess sections 28 and 42 form an open chamber 44, which is sized and configured for receipt and display of a preselected article. Preferably the chamber 44 is larger than the article, so that same achieves a realistic orientation when the package P is hung vertically for display.

The article to be displayed is preferably a ceiling fan extension chain, comprising a ball chain 46 and a knob 48. The chain 46 may be brass or otherwise colored, with the knob 48 having essentially any configuration and coloration as may be desired. It can be seen in FIG. 3 that the chain 46 and knob 48 hang vertically within chamber 44, so that they accurately represent the orientation which the chain 46 and knob 48 would have when attached to a ceiling fan. The consumer thus may more realistically and easily appreciate the appearance that the chain 46 and knob 48 would convey when hung from a ceiling fan, thus potentially increasing the likelihood of a sale. Moreover, because chain 46 extends along the channel of finger portion 22, then maximum display of the chain length consistent with package dimensions is provided. Naturally, alignment of finger portion 22 with circular recess 40 may be adjusted as desired.

In order to secure the chain 46 so that the chain 46 and knob 48 will hang vertically in essentially a longitudinally immovable manner when the package P is hung from a hook extending through openings 18 and 38, then I provide an insert 50 which preferably is formed of opaque cardboard or like material. Insert 50, as best shown in FIGS. 3–4 and 6, has a first portion 52 which is juxtaposed to second portion 20 of second component 14 and which overlies circular recess 40. Because the first portion 52 overlies the circular recess 40, then that portion of the ball chain 46 which is not disposed within chamber 44 is hidden from view and does not detract from the aesthetically pleasing appearance of the package P. Circular opening 54 is formed within insert 50, and a slot 56 extends downwardly therefrom in order to capture a chain link extending between adjacent balls 58 of ball chain 46. Preferably the opening 54 is slightly larger in diameter than the diameter of the balls 58, in order to permit same to be passed readily therethrough during assembly. The slot 56, on the other hand, need not extend very far, and simply provides a capture region for holding a link 60 and to permit the chain 46 from thereafter being able to move. The capture region alternative may be provided by glue, a twisted wire, or the like.

Insert 50 has flat portion 62 extending therefrom, disposed behind chain 46 in the area of finger portion 22. Insert 50 furthermore has portions 64, 66 and 68 extending about recess section 42 and overlying the lower portion 70 of recess section 28, as best shown in FIG. 3. Because the insert 50 is a stiff cardboard or similar fibrous material which may be printed upon, then the insert 50 is available to provide consumer information about the product being displayed, its manufacture, price, and like information. Additionally, shoulders 53 and 55 of insert 50 seat the insert within second portion 20, thus maintaining orientation of the insert 50 within package P.

Circular recess 40 and recess section 42 are preferably inwardly formed relative to the side edges 72 and 74 of component 10. I prefer that first component 10 be molded to form a plateau in order to align with and interfit with the stiffening recess of second component 14. In other words, the component 10 has a base or rim 75, and an upper planar section 77 within which the recess sections 40 and 42 are formed.

Because the package P is a clam shell package, then formed in upper portion 16 are detents 76 and 78, with the detent 78 being shown in cross section in FIG. 5. Locks 80 and 82 are formed in upper portion 36 of first component 10, and are received within the detents 76 and 78 in order to releaseably secure the components 10 and 14 together. Those skilled in the art will recognize that other types of securement may be used for locking the components together, such as adhesive, heat sealing, or the like. I prefer that it be relatively difficult to separate the components 10 and 14, in order to reduce theft losses which otherwise might occur. Similarly, because the package P is relatively much larger than the chain 46 and knob 48, it is more difficult to conceal same.

Use of the package P is relatively simple, because the components 10, 12, and 14 may be vacuum formed from a single plastic sheet. The insert 50 may be die cut or otherwise prepared, with the chain 46 and knob 48 being secured from any number of sources. In order to assemble the package P, then the chain 46 is caused to pass through the opening 54 by an amount sufficient to assure that the knob 48 will be spaced above insert portion 68 and hang freely and vertically within package P. The appropriate link 60 of the chain 46 is moved downwardly into the slot 56, in order to be captured there and thus be immovably retained. Excess chain 46 is then positioned within circular recess 40. Insert 50 is positioned so that portion 52 is seated within second section 20, and portions 64, 66, and 68 oriented within section 42. Chain 16 may thus be positioned within the channel of finger portion 22. Components 10 and 14 are then pivoted about hinge 12 into overlying relation, with the locking elements 76–82 then being secured together. The package P may be shipped to the retailer, and thus hung by openings 18 and 38 from a hook or other fixture for display to the consumer.

While this invention has been described as having a preferred design, it is understood that it is capable of further modifications, uses, and/or adaptations of the invention. Following the general principles of the invention and including such departures from the present disclosure as come within known or customary practice in the art to which the invention pertains, and as may be applied to the central features hereinbefore set forth, and fall within the scope of the invention of the limits of the appended claims.

What I claim is:

1. A package for displaying pull chains, comprising:

a) a first transparent package component having a recess spannning substantially the entirety thereof, said recess having first and second sections and said second section sized and configured for receipt of a preselected article;

b) a second package component, said second package component having first and second spaced apart recess sections and said second component second recess section aligned with said first component second recess section for therewith forming a chamber;

c) an insert positioned within said first component recess and in overlying relation to said second component recess sections, said insert having a capture region intermediate said second component recess sections for securing an article having a portion thereof to be disposed within said chamber for display; and d) said first and second components being secured together.

2. The package of claim 1, wherein:

a) a hinge pivotally connects said components along first end portions thereof.

3. The package of claim 2, wherein:

a) said components are integral, and each of said component is transparent.

4. The package of claim 1, wherein:

a) said second component has a plateau portion aligned with said first component recess and being seated therein.

5. The package of claim 4, wherein:

a) said second component recess sections are formed in said plateau portion.

6. The package of claim 5, wherein:

a) said second component first recess section is circular in plan, and said second recess section is rectangular in plan.

7. The package of claim 5, wherein:

a) said first component recess includes a finger portion, and said finger portion is longitudinally aligned with said circular recess section.

8. The package of claim 7, wherein:

a) said components each have a length dimension and a width dimension, and said finger portion extends in said length dimension.

9. The package of claim 8, wherein:

a) said finger portion is centrally disposed relative to said width dimension.

10. The package of claim 1, wherein:

a) said capture region includes a slot in which a portion of the article is received.

11. The package of claim 10, wherein:

a) said insert has a first portion juxtaposed to said first component first recess section and a second portion juxtaposed to said second compartment second recess section.

12. The package of claim 11, wherein:

a) said first portion overlies said second component first recess section.

13. The package of claim 12, wherein:

a) said insert has oppositely disposed shoulders for seating said first portion within said first component first recess section.

14. The package of claim 13, wherein:

a) said insert is formed of a fibrous material.

15. The package of claim 1, wherein:

a) a hinge pivotally interconnects said components along cooperating first edges; and b) locking elements secure said components along cooperating second edges.

16. The package of claim 15, wherein:

a) said locking elements releaseably secure said components.

17. A display package, comprising:

a) a first transparent package component having a recess sized and configured for receipt of an article to be displayed;

b) a second package component secured to said first component, said second component having a first recess section and a second recess section and said second recess section aligned with and cooperating with said recess for therewith forming a chamber;

c) an insert having a first portion positioned within said recess and a second portion disposed within said second component second recess section, said first portion having a capture region; and d) an article to be displayed, including a chain received within said capture region and a knob suspended from said chain within said chamber.

18. The package of claim 17, wherein:

a) a hinge pivotally interconnects said components along cooperating first edges; and b) lock assemblies releaseably secure said components along cooperating second edges.

19. The package of claim 18, wherein:

a) said recess includes a finger portion and said chain is received within and extends along said finger portion.

* * * * *